US006689703B1

(12) United States Patent
Kobayashi et al.

(10) Patent No.: US 6,689,703 B1
(45) Date of Patent: Feb. 10, 2004

(54) ELASTICALLY STRETCHABLE NONWOVEN FABRIC AND PROCESS FOR MAKING THE SAME

(75) Inventors: Toshio Kobayashi, Kanagawa-ken (JP); Satoru Tange, Kanagawa-ken (JP); Masaki Yoshida, Kanagawa-ken (JP); Emiko Inoue, Kanagawa-ken (JP)

(73) Assignee: Uni-Charm Corporation, Kawanoe (JP)

( * ) Notice: Subject to any disclaimer, the term of this patent is extended or adjusted under 35 U.S.C. 154(b) by 104 days.

(21) Appl. No.: 09/604,663

(22) Filed: Jun. 27, 2000

(30) Foreign Application Priority Data

Jun. 28, 1999 (JP) ..... 11-181825

(51) Int. Cl.[7] ..... D04H 1/00; D04H 13/00; D04H 3/00; D04H 5/00; D04H 1/06; D04H 1/56; D04H 1/46; D04H 3/10; D04H 1/54; D04H 3/14; D04H 5/06; D02G 3/00

(52) U.S. Cl. ..... 442/328; 442/329; 442/352; 442/356; 442/357; 442/359; 442/360; 442/400; 442/403; 442/409; 428/369; 428/371

(58) Field of Search ..... 442/328, 329, 442/352, 356, 357, 359, 360, 403, 409, 400; 428/369, 371

(56) References Cited

U.S. PATENT DOCUMENTS 3,034,196 A * 5/1962 Bohmfalk ..... 442/189
3,523,345 A * 8/1970 Hughes ..... 28/259
3,929,542 A 12/1975 Gehrig et al.
4,107,364 A 8/1978 Sisson
4,296,163 A 10/1981 Emi et al.
4,551,378 A * 11/1985 Carey, Jr. ..... 442/362
5,098,636 A 3/1992 Balk
5,326,612 A * 7/1994 Goulait ..... 428/100
5,462,793 A * 10/1995 Isoda et al. ..... 428/297
5,695,377 A 12/1997 Triebes et al.
5,711,970 A 1/1998 Lau et al.
5,882,780 A * 3/1999 Yamamura et al. ..... 428/229
6,058,541 A * 5/2000 Masterman et al. ..... 15/28
2001/0051485 A1 * 12/2001 Gentile et al. ..... 442/352

OTHER PUBLICATIONS

Patent Abstract of Japan No. 10060765, Mar. 3, 1998.

Patent Abstract of Japan No. 04100963, Apr. 2, 1992.

* cited by examiner

*Primary Examiner*—Elizabeth M. Cole
*Assistant Examiner*—Jeremy R Pierce
(74) *Attorney, Agent, or Firm*—Lowe Hauptman Gilman & Berner LLP

(57) ABSTRACT

An elastically stretchable nonwoven fabric including thermoplastic elastomer filaments; the filaments being heat-sealed and/or mechanically intertwined together to form the nonwoven fabric that has crimped regions and non-crimped regions wherein each of the crimped regions has fine crimps in the rate of 50/cm or higher.

9 Claims, 2 Drawing Sheets

ELASTICALLY STRETCHABLE NONWOVEN FABRIC AND PROCESS FOR MAKING THE SAME

BACKGROUND OF THE INVENTION

This invention relates to a nonwoven fabric made of elastically stretchable filaments and a process for making the same.

Japanese Patent Application Disclosure No. 1998-60765 describes an elastically stretchable nonwoven fabric obtained using the known melt blown method. This known nonwoven fabric of prior art comprises a plurality of superfine, elastic and continuous component fibers heat-sealed together partially along intermittent lengths thereof and partially at intermittent points therealong. The heat-sealing is performed so that the number of lines and points along and at which the component fibers are crimped should not exceed a predetermined number. This is for the purpose of alleviating a rubber-like touch due to the elastic fibers. According to the disclosure of the Patent Application, the number of the linearly heat-sealed regions is preferably in a range of about 500~3,000/cm$^2$ and the number of the linearly heat-sealed regions more than 3,000 will generate the undesirable rubber-like touch.

The prior art improves a strength of elastic stretchable nonwoven fabric by partially heat-sealing the superfine component fibers together along intermittent length thereof. In addition, the prior art limits the number of the heat-sealed regions to a predetermined number or less and thereby successfully relieves the nonwoven fabric of an apprehension that the nonwoven fabric might exhibit the undesirable rubber-like touch if the number of the heat-sealed regions exceeds said predetermined number. However, such nonwoven fabric of prior art is not sufficiently bulky in its thickness direction to avoid a thin and flat paper-like touch peculiar to nonwoven fabrics of this type.

SUMMARY OF THE INVENTION

An object of this invention is to relieve the nonwoven fabric comprising elastically stretchable filaments of the rubber-like touch as well as of the flat touch.

This invention to achieve such an object has a first aspect relating to an elastically stretchable nonwoven fabric and a second aspect relating to a process for making the nonwoven fabric.

According to the first aspect of this invention, there is provided an elastically stretchable nonwoven fabric comprising a plurality of thermoplastic elastomer filaments heat-sealed and/or mechanically entangled together, the filaments having crimped regions and non-crimped regions wherein each of the crimped regions has fine crimps in the rate of about 50/cm or higher.

According to the second aspect of this invention, there is provided a process for making elastically stretchable nonwoven fabric comprising the steps of:

a. blowing against thermoplastic elastomer extruded in one direction from a plurality of nozzles arranged in an array a hot blast heated at a temperature higher than a melting point of the elastomer in the one direction so that the filaments still in a molten state thereof are moved in the one direction; and b. blowing against the filaments at a temperature between the melting point of the filaments and a room temperature a warm blast or a cold blast at a temperature at least 20° C. lower than said melting point of the filaments so that surfaces of said filaments may be unevenly cooled and said filaments may be at least partially crimped, and to accumulate said filaments on conveyor means running transversely of said one direction wherein, in the course from said step of blowing said hot blast against said thermoplastic elastomer to accumulating said filaments on said conveyor means, said filaments are heat-sealed or mechanically intertwining together to obtain the elastic stretchable nonwoven fabric.

According to one preferred embodiment of said second aspect of this invention, an airflow of said hot blast is 0.5~2.5 Nm$^3$/min per blow width of 1 m.

According to another preferred embodiment of said second aspect of this invention, said warm blast or cold blast is at a temperature of 90~10° C.

DETAILED DESCRIPTION OF THE PREFERRED EMBODIMENTS

An elastically stretchable nonwoven fabric and a process for making the same will be described in more details with reference to the accompanying drawings.

Figure 1:
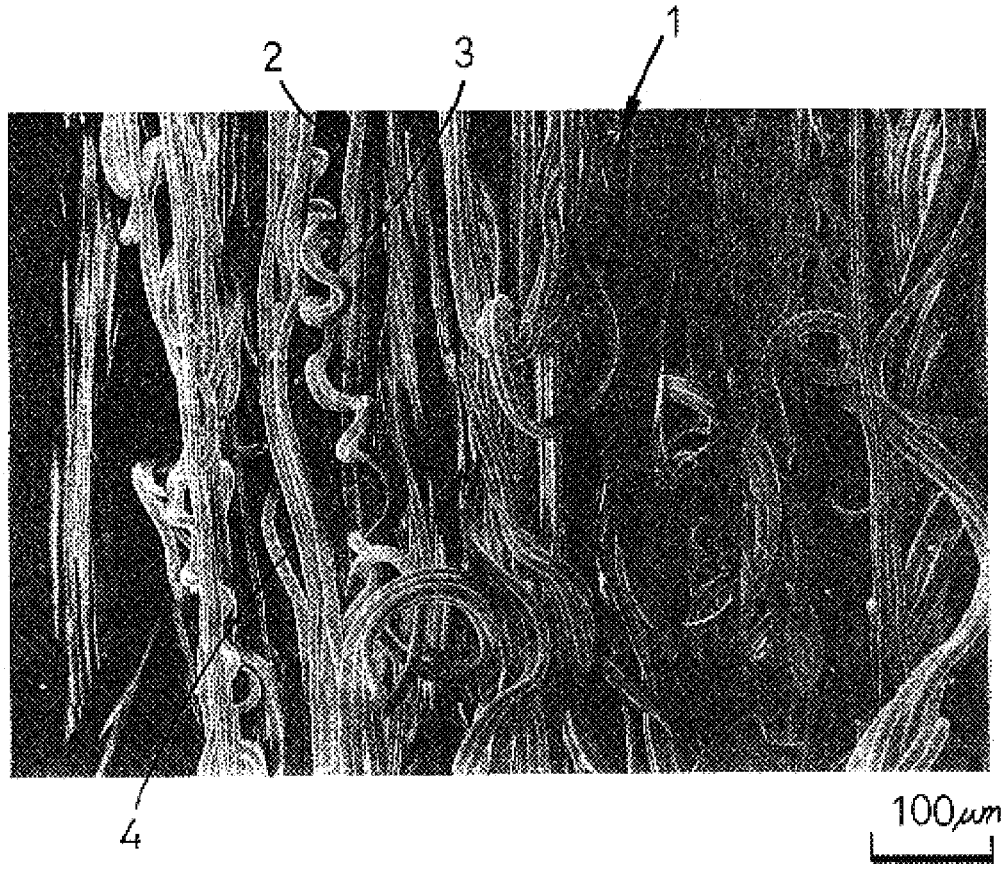
FIG. 1 is a photo of 150 magnifications showing a part of a nonwoven fabric according to this invention.

FIG. 1 is a diagram (photo)of 150 magnifications showing a part of an elastically stretchable nonwoven fabric 1. The nonwoven fabric 1 comprises a plurality of thermoplastic elastomer filaments 2, each having a diameter of 1~30 $\mu$m, assembled together by heat-sealing and/or mechanically entangling them so that the nonwoven fabric 1 as a whole may have a basis weight of 30~100 g/m$^2$. The filaments 2 extend substantially in one direction and have crimped regions 3 and non-crimped regions 4 irregularly appearing longitudinally of the filaments 2. Each of the filaments 2 includes at least 50 fine crimps/cm in each of the crimped regions 3 and extends in the one direction linearly or with a gentle curve non-crimped regions 4. The crimped region(s) 3 can be observed along 15~100% of the filaments 2 when the nonwoven fabric 1 is observed at random for an area of 0.78×0.65 mm.

The crimped regions 3 formed along the filaments 2 are effective to improve a bulkiness in the thickness direction and therefore a cushioning property of the nonwoven fabric 1 over the nonwoven fabric in which the filaments 2 have none of such crimped regions 3. In addition, the nonwoven fabric according to this invention advantageously achieves a lower initial stretch stress and a higher elongation at break than those achieved by the nonwoven fabric with their component filaments having none of the crimped regions. This is because, in the case of the nonwoven fabric 1 according to this invention, not only the elastomer filaments 2 are stretched but also the crimped regions 3 allow the filaments 2 to be further stretched.

Furthermore, regardless of a filament fiber diameter being relatively small, the nonwoven fabric 1 of this invention is free from a paper-like touch peculiar to the melt blown nonwoven fabric.

Figure 2:
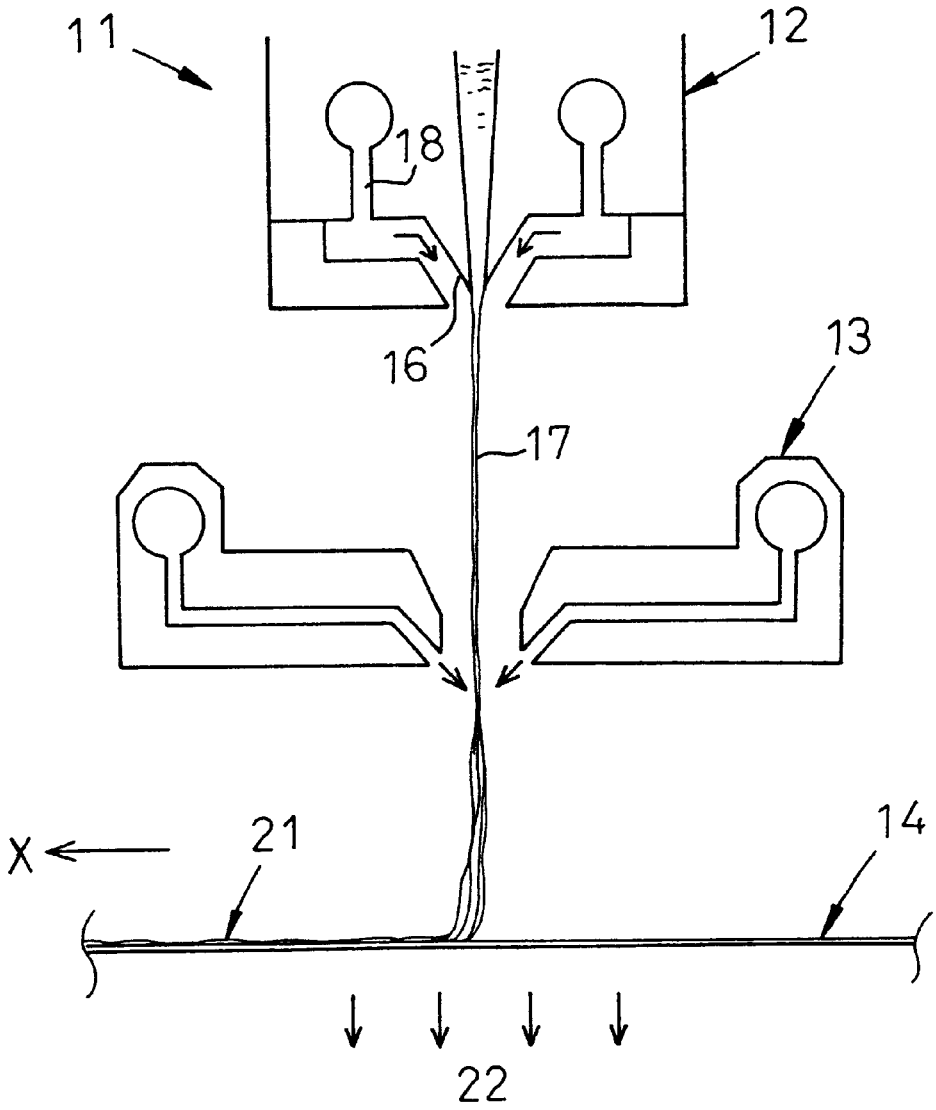
FIG. 2 is a diagram schematically illustrating an apparatus for making said nonwoven fabric.

FIG. 2 is a diagram schematically illustrating an apparatus 11 of making the nonwoven fabric 1. The apparatus 11 comprises an extruder 12, a blower for cold blast 13 and an endless belt 14 running in a direction indicated by an arrow X. The extruder 12 is of a well known type for making melt blown fibers and includes nozzles 16 adapted to extrude molten resin into filaments 17 and a blower of hot blast 18 adapted to blow downward hot blast against the filaments 17 still in its molten state so that the filaments 17 may be progressively reduced in their diameters as they moved downward. The extruder 12 includes various components generally required for its essential function such as a plurality of nozzles arranged in an array, a feeding hopper for resin as raw-material, screw and heater for mixing the resin, though not illustrated in FIG. 2.

The blower of hot blast 18 preferably ensures an airflow of 0.5~2.5 $Nm^3$/min per unit blow width of 1 m while the blower of cold blast 13 preferably ensures an airflow of 1~20 $Nm^3$/min, more preferably of 3~10 $Nm^3$/min per unit width of 1 m.

The filaments 17 in its molten state are progressively cooled, as they move downward, first to a temperature at which they exhibit a semi-molten state and finally to a room temperature at which they exhibit their normal state as the desired filaments. The blower of cold blast 13 blows a warm or cold blast at a temperature between a melting point of the filaments 17 and a temperature slightly lower than a room temperature, preferably at a temperature at least 20° C. lower than the melting point of the filaments 17, more preferably at a temperature of 90~10° C. against the filaments 17 at least in two directions, preferably from laterally opposite sides of the filaments 17 as will be apparent from FIG. 2. The filaments 17 thus blown with warm or hot blast are cooled as they are stretched and reduced in their diameter. During such process, the filaments 17 are not cooled at a uniform rate as a whole but at locally different rates and with vibrations of locally different intensities. As a result, the filaments 17 are deformed until they are cooled to the room temperature in the forms of fine crimps, curves or crookedness in various directions as seen in FIG. 1. Finally, the filaments 17 accumulated on the conveyor belt 14 under the effect of a suction 22 provided below said conveyor belt 14. In this course from having been extruded by the extruder 12 to being accumulated on the conveyor belt 14, the filaments 17 come in contact one with another under the effect of the blower of hot blast 18 and the blower of cold blast 13. After accumulated on the conveyor belt 14 also, the filaments 17 come in contact one with another. In this manner, the filaments 17 are heat-sealed and mechanically intertwined together to form nonwoven fabric 21. The nonwoven fabric 21 and filaments 17 correspond to the nonwoven fabric 1 and the filaments 2 as shown by FIG. 1.

The apparatus 11 may be operated using, for example, styrene elastomer under conditions as follow:

| | |
|---|---|
| nozzles of the extruder: | |
| diameter: | 0.35 mm |
| number of holes: | 601 |
| hole pitch: | 1 mm |
| resin: | |
| temperature: | 270° C. |
| discharge rate: | 13 g/min/hole |
| blower of hot blast: | |
| lip width: | 800 mm |
| airflow: | 1.5 $Nm^3$/min |
| blast temperature: | 270° C. |

-continued

| | |
|---|---|
| blower of cold blast: | |
| lip width: | 750 mm |
| airflow: | 6 $Nm^3$/min |
| blast temperature: | 25° C. |
| belt: | |
| distance from the extruder's nozzles: | 320 mm |
| travelling speed: | 2.9 m/min |

The filaments 17 of the nonwoven fabric 21 obtained under the conditions set forth above have been found to have an average diameter of 11.4 $\mu$m and a plurality of fine crimps at the rate of 88/cm.

Experimentally, the apparatus 11 was operated under the conditions set forth above without using the blower of cold blast 13 and the nonwoven fabric obtained was evaluated. The component filaments of this nonwoven fabric were less stretched than the filaments 17 and an average diameter of 20.5 was 20.5 $\mu$m. The filaments obtained by this experimental operation had substantially no crimps or had crimps as rough as in the rate of less than 50/cm. Changing-over the airflow of the blower of hot blast 18 from 1.5 $Nm^3$/min (i.e., 1.9 $Nm^3$/min per blow width of 1 mm) to 2.5 $Nm^3$/min (i.e., 3.3 $Nm^3$/min per blow width of 1 mm) and further to 3.0 $Nm^3$/min(i.e., 3.8 $Nm^3$/min per blow width of 1 mm) progressively reduced the average diameter to 14.6 $\mu$m and 11.3 $\mu$m, respectively. However, the rate of crimps formed along the filaments was less than 50/cm.

To exploit this invention, in addition to the previously described styrene elastomer, polyolefine or polyester elastomer also may be used as the thermoplastic elastomer.

The elastically stretchable nonwoven fabric according to this invention can advantageously afford the nonwoven fabric comprising thermoplastic elastomer filaments of an extremely small fineness a desired bulkiness since these component filaments are formed with the fine crimps. Consequently, this nonwoven fabric is free from a flat paper-like touch as unexceptionally exhibited by the conventional melt blown nonwoven fabric using elastomer fiber. The nonwoven fabric according to this invention can be easily obtained by the process according to this invention comprising a step of blowing warm or cold blast against the filaments which have been extruded from the extruder and subjected to a hot blast.

What is claimed is:

1. An elastically stretchable nonwoven fabric, comprising a plurality of thermoplastic elastomer filaments heat-sealed and/or mechanically entangled together, each of said filaments having crimped regions and non-crimped regions, wherein each of said crimped regions has at least 50 crimps per centimeter; and the filaments extend substantially in the same direction.

2. The fabric of claim 1, wherein the filaments have a diameter of from about 1 to about 30 $\mu$m.

3. The fabric of claim 1, wherein the fabric has a basic weight of from about 30 to about 100 $g/m^2$.

4. The fabric of claim 1, wherein the crimped regions are observed in from about 15 to about 100% of the filaments in a randomly selected area of 0.78 mm by 0.65 mm of said fabric.

5. The fabric of claim 1, wherein said filaments are continuous fibers extending substantially in the machine direction (MD-direction) of said fabric.

6. An elastically stretchable nonwoven fabric, comprising a plurality of thermoplastic elastomer filaments heat-sealed and/or mechanically entangled together, each of said filament having crimped regions and non-crimped regions, wherein each of said crimped regions has at least 50 crimps per centimeter; and an entirety of said fabric is made of a material of said filaments.

7. An elastically stretchable nonwoven fabric, comprising a plurality of thermoplastic elastomer filaments heat-sealed and/or mechanically entangled together, each of said filaments having crimped regions and non-crimped regions, wherein each of said crimped regions has at least 50 crimps per centimeter; and said filaments are continuous fibers.

8. The fabric of claim 7, wherein the continuous fibers extend substantially in the same direction which is the machine direction (MD-direction) of said fabric.

9. The fabric of claim 7, wherein said fabric consists of said continuous fibers.

* * * * *